US006056867A

United States Patent [19]

Burgher et al.

[11] Patent Number: 6,056,867

[45] **Date of Patent: *May 2, 2000**

[54] LADDER ANODE FOR CATHODIC PROTECTION

[75] Inventors: John William Burgher; Dennis F. Dong, both of Kingston, Canada; Richard E. Loftfield, Jacksonville, Fla.

[73] Assignee: Huron Tech Canada, Inc., Kingston, Canada

[ * ] Notice: This patent is subject to a terminal disclaimer.

[21] Appl. No.: 09/173,046

[22] Filed: Oct. 15, 1998

Related U.S. Application Data

[63] Continuation-in-part of application No. 08/593,507, Jan. 30, 1996.

[51] Int. Cl.[7] ..... C23F 13/00

[52] U.S. Cl. ..... 205/734; 204/196.33; 204/196.36; 204/196.38; 204/284; 204/290 F

[58] Field of Search ..... 204/196.01, 196.1, 204/196.2, 196.21, 196.33, 196.36, 196.38, 284, 290 F; 205/724, 734, 735, 736

[56] References Cited

U.S. PATENT DOCUMENTS

| | | | |
|---|---|---|---|
| 2,838,453 | 6/1958 | Randall | 204/196.2 |
| 3,907,659 | 9/1975 | Paige | 204/292 |
| 4,855,024 | 8/1989 | Drachnik et al. | 205/734 |
| 4,997,492 | 3/1991 | Taki | 204/293 |
| 5,062,934 | 11/1991 | Mussinelli . | |
| 5,104,502 | 4/1992 | Mussinelli . | |
| 5,423,961 | 6/1995 | Bennett et al. . | |
| 5,451,307 | 9/1995 | Bennett et al. . | |
| 5,569,526 | 10/1996 | Tettamanti et al. | 204/290 F |

FOREIGN PATENT DOCUMENTS

| | | |
|---|---|---|
| 896912 | 5/1962 | United Kingdom . |

*Primary Examiner*—T. Tung
*Attorney, Agent, or Firm*—Andrew E. Pierce

[57] ABSTRACT

A flexible, nonstretchable, titanium, ladder anode for cathodic protection of steel reinforced concrete structures formed of multiple titanium strips including multiple electric current-carrying titanium strips. Ladder anodes of titanium without an electrocatalytically active metal coating can be used in a cathodic protection system operated at an anode current density up to about 20 milliamps per square foot. Ladder anodes of titanium having an electrocatalytically active metal coating are additionally useful at higher anode current densities. The ladder anodes form at the intersections of the strips less than 200 nodes per square meter and have a surface area of about 500 to about 900 square inches per pound.

26 Claims, 4 Drawing Sheets

LADDER ANODE FOR CATHODIC PROTECTION

This application is a continuation-in-part of application Ser. No. 08/593,507, filed Jan. 30, 1996.

BACKGROUND OF THE INVENTION

1. Field of the Invention

This invention is directed to anodes in the form of a ladder for use in cathodic protection systems.

2. Description of Related Prior Art

Cathodic protection of metal structures, or of metal containing structures, in order to inhibit or prevent corrosion of the metal in the structure is well known by use of impressed current cathodic protection systems. In such systems, counter electrodes and the metal of the structure are connected to a source of direct current. In operation the metal of the structure, such as a steel reinforcement for a concrete structure, is cathodically polarized. The steel reinforcement becomes cathodically polarized being spaced from the anodically polarized electrode and is inhibited against corrosion. While cathodic protection is well known for metal or metal containing structures such as in the protection of offshore steel drilling platforms, oil wells, fuel pipes submerged beneath the sea, and in the protection of the hulls of ships, a particularly difficult problem is presented by the corrosion of steel reinforcement bars in steel-reinforced concrete structures. Most Portland cement concrete is porous and allows the passage of oxygen and aqueous electrolytes. Salt solutions which remain in the concrete as a consequence of the use of calcium chloride to lower the freezing point of uncured concrete or snow or ice melting salt solutions which penetrate the concrete structure from the environment can cause more rapid corrosion of steel reinforcing elements in the concrete. For example, concrete structures which are exposed to the ocean and concrete structures in bridges, parking garages, and roadways which are exposed to water containing salt used for deicing purposes are weakened rapidly as the steel reinforcing elements corrode. This is because such elements when corroded create local pressure on the surrounding concrete structure which brings about cracking and eventual spalling of the concrete.

Impressed current cathodic protection systems are well known for the protection of reinforced concrete structures such as buildings and in road construction, and, particularly, in the fabrication of supports, pillars, cross-beams, and road decks for bridges. Over the years, increasing amounts of common salt, sodium chloride, have been used during the winter months to prevent ice formation on roads and bridges. The melted snow or ice and sodium chloride in aqueous solution tend to seep into the reinforced concrete structure. In the presence of chloride ion the reinforcing steel rebars are corroded at an accelerated rate such that the resultant corrosion products formed by the oxidation reaction occupy a greater volume than the space occupied by the reinforcing bars prior to oxidation. Eventually an increased local pressure is created which brings about cracking of the concrete and eventual spalling of the concrete covering the reinforcing members so as to expose the reinforcing members directly to the atmosphere. The use of a valve metal without an electrocatalytically active coating thereon as an anode in a cathodic protection system is unexpected in view of the belief among those skilled in the art that a titanium anode or an alloy of titanium possessing properties similar to titanium cannot be used in an electrolytic process as the surface of the titanium would oxidize when anodically polarized and the titanium or alloys thereof would soon cease to function as an anode.

For instance, in U.S. Pat. No. 5,334,293, electrocatalytically coated anodes of titanium or an alloy of titanium are disclosed for use in an electrolytic cell, particularly, for use as an anode in an electrolytic cell in which chlorine is evolved at the anode. The coating utilized usually includes a metal of the platinum group, oxides of metals of the platinum group, or mixtures of one or more metals such as one or more oxides or mixtures or solid solutions of one or more oxides of a platinum group metal and a tin oxide or one or more oxides of a valve metal such as titanium. Similar electrocatalytically coated titanium electrodes are disclosed in U.S. Pat. No. 3,632,498; U.S. 5,354,444; and U.S. 5,324,407.

Known methods of introducing an anode into existing concrete structures may involve insertion of an anode into a slot cut into the concrete. After application of the anode a cap of grout is applied to backfill the slot. Representative anodes for cathodic protection of steel reinforced concrete structures are disclosed in U.S. Pat. No. 5,062,934 to Mussinelli in which a grid electrode comprised of a plurality of valve metal strips having voids are disclosed. Another type of anode strip for cathodic protection of steel reinforced concrete structures is disclosed in Canadian 2,078,616 to Bushman in which mesh anodes are disclosed consisting of an electrocatalytically coated valve metal which is embedded in a reinforced concrete structure so as to function as the anode in a cathodic protection system. In U.S. Pat. No. 5,031,290 a process is disclosed for the production of an open metal mesh having a coating of an electrocatalytically active material formed by fitting a sheet and stretching the coated sheet to expand the sheet and form an open mesh. In U.S. Pat. No. 4,401,530 to Clere, a three dimensional electrode having substantially coplanar, substantially flat portions, and ribbon-like curved portions is disclosed for use as a dimensionally stable anode in the production of chlorine and caustic soda. The ribbon-like portions of the anode are symmetrical and alternate in rows above and below the flat portions of the anode.

In U.S. Pat. No. 3,929,607 to Krause, an anode assembly for an electrolytic cell is disclosed comprising a film-forming metal foraminate structure comprising a plurality of longitudinal members spaced with their longitudinal axis parallel to one another and carrying on at least part of their surface an electrocatalytically active coating. Each longitudinal member comprises a channel blade member constituted by a pair of parallel blades having one or more bridge portions connected to the current lead-in means.

It is known from U.S. Pat. No. 5,334,293 that a titanium anode cannot be used in an electrolytic cell, particularly in an electrolytic cell in which during operation of the cell chlorine is evolved at the anode. Such an anode cannot be used in this electrolytic cell as the surface of the titanium anode would oxidize when anodically polarized and the titanium would soon cease to function as an anode. Coatings comprising ruthenium oxide are disclosed as useful on a titanium substrate to obtain an electrode having a commercially useful lifetime.

Bockris et al. in *Modern Electrochemistry,* volume 2, pages 1315–1321, Plenum Press, explains the transformation of a metal surface from a corroding and unstable surface to a passive and stable surface as being facilitated by increasing the electrical potential in the positive direction on the metal. As the potential is increased, the current initially increases, reaching a maximum value and then starts sharply to decrease to a negligible value. The point at which the current sharply decreases is referred to as passivation and the potential at which this occurs is termed the passivation potential.

In the prior art, electrodes particularly for use in cathodic protection systems require electrocatalytic coatings on valve metals which are subject to passivation in order to overcome the tendency of such metals to passivate and cease to function as electrodes. Such coatings are described in U.S. Pat. No. 3,632,498 as consisting essentially of at least one oxide of a film-forming metal and a nonfilm-forming conductor the two being in a mixed crystal form and covering at least two percent of the active surface of the electrode base metal. Similarly, electrodes made utilizing a valve metal substrate are disclosed as requiring one or more layers of a coating containing platinum as disclosed in U.S. Pat. No. 5,290,415 and U.S. 5,395,500.

An anode useful in a cathodic protection system to protect the reinforcing steel bars in a concrete structure can consist of a porous titanium oxide, $TiO_x$ where "x" is in the range 1.67 to 1.95, as disclosed in European patent application 186 334 or where "x" is in the range 1.55 to 1.95, as disclosed in U.S. Pat. No. 4,422,917. Other porous materials are disclosed in 186 334 as substitutes for the porous titanium oxide such as graphite, porous magnetite, porous high silicon iron or porous sintered zinc, aluminum or magnesium sheet.

In U.S. Pat. No. 4,319,977, an electrode formed of thin sheets of titanium is disclosed as useful in an electrometallurgical cell. In addition to a metal such as titanium, electrodes consisting essentially of tantalum, niobium, or zirconium are disclosed as useful in the British patent No. 951,766 cited in this United States patent. As described in '977, the titanium electrode is utilized as an anode in a method of electrolytically producing manganese dioxide by immersing the electrode in a solution of manganese sulphate and sulfuric acid and electrolytically depositing the manganese dioxide onto the electrode. Periodically, the manganese dioxide is removed from the electrode.

Expanded mesh anode structures having an electrocatalytic surface which are disclosed as useful for cathodic protection of steel reinforced concrete are disclosed in U.S. Pat. No. 5,421,968, U.S. Pat. Nos. 5,423,961, and 5,451,307. These mesh anode structures have 500 to 2000 nodes per square meter formed at metal strand intersections in the mesh and can be supplied in roll form. Upon application to a concrete surface in order to present corrosion of steel reinforcing structures therein, the expanded metal mesh is connected to a current distribution member such as by welding.

A grid electrode is disclosed for use in cathodic protection of steel reinforced concrete structures and a method of forming a grid electrode are disclosed, respectively, in U.S. Pat. No. 5,062,934 and U.S. 5,104,502. The metal members forming the grid electrode comprise a plurality of expanded valve metal strips with voids therein, at least 2000 nodes per square meter formed by intersecting strands of expanded metal, and an electrocatalytic surface thereon. The valve metal strips forming the electrode grid are welded together to form the grid. In use, a current distribution member is also connected at intervals to the electrode grid.

SUMMARY OF THE INVENTION

Disclosed are novel ladder electrodes of titanium or alloys thereof for operation at either high or low current density, particularly, as anodes in a cathodic protection system in which iron or steel rods are embedded in a concrete structure or as anodes for the cathodic protection of steel pipelines placed in sea water, saline muds, or in the ground. The steel rods or pipelines are protected against corrosion by connecting the novel valve metal ladder anodes and the iron or steel pipelines or reinforcing rods in the concrete structure to an electrical circuit and impressing a current sufficient to cause the iron or steel material to act as a cathode in the circuit. The longitudinally extending metal strips which are spaced apart and connected by laterally extending strips to form the ladder electrode can be porous or non-porous, coated with an electrocatalytically active metal or non-coated. The anode strips can be formed of unexpanded or expanded metal, slit and deformed metal, and tubular shaped metal. Rectangular shaped longitudinally and laterally extending strips are required to obtain a desired surface area of about 500 to about 900 square inches per pound.

BRIEF DESCRIPTION OF THE DRAWINGS

FIG. 1 is a plan view of an example of a portion of a unitary, multi-plane, porous, metal strip or ribbon showing a plurality of louvers arranged laterally across the metal strip.

FIG. 2 is a side view of the metal strip of FIG. 1.

FIG. 3 is an enlarged side view taken through section 3—3 of FIG. 1.

FIG. 4 is a plan view of yet another example of a portion of a unitary, multi-plane, porous, metal strip showing a series of louver units oriented on a metal strip in a direction parallel to the longitudinal direction of the metal strip and spaced apart from adjacent louver units by a plane which is intermediate between the planes defined by the upper and lower lateral extremities of said louvers.

FIG. 5 is a side view of the metal strip of FIG. 4.

FIG. 6 is an isometric view of the metal strip of FIG. 1.

FIG. 7 is an isometric view of the metal strip of FIG. 4.

FIG. 8 is a plan view of one example of a portion of a unitary, multi-plane, porous, metal ribbon strip showing perforation or slitting of a metal sheet with openings of predetermined size, shape and arrangement and bending the slit strips to form trough and crest nodes.

FIG. 9 is a cross sectional view of the perforated strip shown in FIG. 13 showing the appearance on bending the perforated strip so as to raise upper, crest and lower, trough nodes in a direction normal to the plane of the largest dimension of the perforated strip.

FIG. 10 is a plan view of a second example of a portion of a unitary, multi-plane, porous, metal strip showing a perforated or slit sheet prior to bending the rows between perforated sections so as to form a metal ribbon having a plurality of trough and crest nodes.

FIG. 11 is a cross sectional view of a portion of the metal ribbon subsequent to bending the rows between perforated sections of the ribbon shown in FIG. 10.

FIG. 12 is an isometric view of a portion of the porous, metal ribbon shown in cross section in FIG. 11.

FIG. 13 is an isometric view of a portion of the metal ribbon shown in cross section in FIG. 9.

Figure 2:
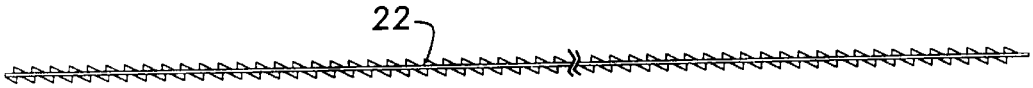
Figure 5:
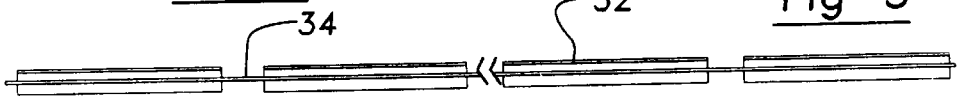

In other embodiments not shown, the louvers of FIGS. 2 and 5 extend only above the base plane of the metal anode strip. In addition to forming the ladder electrode of the metal strips shown and described above, the metal strips can be formed of non-porous metal strips or of the expanded metals shown in the prior art, for instance in U.S. Pat. No. 5,423,961.

DESCRIPTION OF THE PREFERRED EMBODIMENTS

This invention relates, generally, to a cathodically protected concrete structure, a method of forming a ladder electrode cathodic protection system, and to a flexible but nonstretchable ladder electrode for use in a cathodic protection system, particularly for a cathodic protection system to protect a steel reinforced concrete structure. The ladder electrode of the invention is formed of a plurality of porous or non-porous metal strips forming nodes at the intersections of said strips said nodes. Generally, being present in the amount of less than 200 nodes per square meter, preferably, less than 150 nodes and, most preferably, less than 100 nodes per square meter and electrically connected at said intersections to form a ladder such as by welding. The ladder anode can be provided in coil form and when formed of titanium has a surfce area of about 500 to about 900 square inches per pound. Porous or non-porous electric current-carrying metal members consisting of titanium or alloys thereof are also spaced apart on the ladder electrode and laterally extend across at least two longitudinally extending metal strips.

For instance, non-porous, rectangular titanium strips can be used to form the ladder electrode by welding metal strips either with or without an electrocatalytically active metal surface. Non-porous, rectangular, metal strips have a thickness, generally, of about 0.02 centimeter to about 0.08 centimeter, preferably, about 0.03 centimeter to about 0.05 centimeter and most preferably, about 0.03 centimeter to about 0.04 centimeter. Non-porous metal strips have a width, generally, of about 0.2 centimeter to about 1.5 centimeter or more. Ladder anodes will become flimsy and not handle easily in the field if less than 0.02 centimeter in cross-section. In addition, the ladder anode would be prone to easy breakage or bending and would be uneconomic, as relatively expensive to produce. The width of the longitudinal and transverse strips must be large enough so that enough surface area is provided, but not so large as to inhibit the flow of concrete under the strips for good bonding of the concrete overlay or grout. The width should not be so small as to cause the anode structure to become flimsy or easily deformed.

The porous titanium strips used to form the ladder electrode of the invention can be formed, for instance, by slitting and expanding a metal ribbon or strip either in a direction normal to the largest surface or in a direction of the plane of the largest surface of the metal strip. In addition, the metal ladder electrodes can function effectively as anodes in a cathodic protection system, for instance, to protect steel reinforcement elements in a concrete structure whether or not the surface of said metal has an electrocatalytically active metal coating. The ladder electrodes of the invention can be manufactured by welding the strips and supplied for use in roll form for ease of handling. Contrary to prior art grid electrodes, especially of the type in which titanium is highly expanded to form a single grid sheet of expanded metal, the ladder electrodes of the invention can be unrolled and installed without excessive damage to the ladder structure by warpage or breakage of the strands of the expanded metal or splitting of the expanded metal at the expanded metal nodes especially at the edges of the single grid sheet.

The porous, rectangular, titanium strips suitably have a longitudinal strip thickness, generally, of about 0.02 to about 0.08 centimeter, preferably, about 0.03 to about 0.07 centimeter and a width, generally, of about 0.25 to about 1.5 centimeter, preferably, about 0.5 to about 1.0 centimeter. Laterally oriented metal strips, generally, have the same general thickness and preferred thickness and the same width. Alternatively, where a higher current density is required on the ladder anode of the invention either or both longitudinal and lateral strip widths can be, generally, about 0.5 to about 2.5 centimeter, preferably, about 1.0 to about 2.0 centimeter and, most preferably, about 1.2 to about 1.5 centimeter.

In one embodiment, a ladder electrode is formed from a plurality of expanded metal strips which are obtained by slitting a metal strip, for instance, a grade 2 titanium strip and, subsequently expanding the slit strip in a direction normal to the largest dimension surface of the valve metal strip. The titanium strip thus formed is considerably stronger, as indicated by higher tensile strength and hardness levels, than a strip expanded in the direction of the plane of the largest surface of a grade 1 titanium which is typically used in the prior art to provide an expanded titanium grid electrode structure. The ladder electrode of this embodiment of the invention will have a network of nodes, generally, having less than about 200, preferably, less than about 150 and, most preferably, less than about 100 nodes per square meter.

The ladder electrode contains a plurality of electric current-carrying metal members spaced apart from one another and, preferably, extending laterally across at least two metal strips which extend in a longitudinal direction. Generally, the current-carrying titanium strips can extend either longitudinally or laterally or both longitudinally and laterally. The metal current-carrying strips when oriented longitudinally on the ladder electrode can be used in the formation of the ladder electrode of the invention without an electrocatalytically active metal coated surface.

Certain of the porous metal strips used to form the ladder electrode of the invention are disclosed in copending commonly assigned U.S. patent application Ser. No. 08/502,249, filed Jul. 13, 1995, incorporated herein by reference. In all of the embodiments of the titanium ladder electrode of the invention discussed above, the metal ladder anodes without an electrocatalytic surface are for use in electrochemical systems such as cathodic protection systems which can be operated at low current density in accordance with the teachings of copending, commonly assigned U.S. patent application Ser. No. 08/502,248, filed Jul. 13, 1995 and incorporated herein by reference. Accordingly, each of the metal ladder electrodes of the embodiments set forth above can utilize a titanium metal anode without benefit of an electrocatalytic metal coating thereon.

The metal strips forming the ladder anode of the invention can be coated with an electrocatalytic metal coating either before or after forming into a ladder electrode. The ladder electrodes of the invention are capable of being rolled up in coil form subsequent to manufacture to allow ease of transport to a construction site where they are thereafter unrolled and applied to the surface of a concrete structure. In those embodiments in which the ladder is formed by the assembly of metal strips which have been previously slit and expanded in a direction normal to the largest surface area of the strip, the strength and electrical conductivity of the original metal strip before slitting and expansion is retained. In use, a metal current distributing member is placed at intervals in association with the ladder electrode or a series of adjacent ladder electrodes placed on a concrete surface in a cathodic protection system. The metal current-distributing member can be porous or non-porous and can be uncoated. A series of adjacent ladder electrodes on a concrete surface, generally, will be electrically connected by a current distributing member. The current distributing member can be placed laterally at intervals across at least two metal strips or can be longitudinally oriented on the ladder electrode.

The number of metal strips forming the ladder electrode which are placed in a longitudinal direction in the grid electrode, generally, is about 1 to about 4, preferably, about 2 to about 3. At least one of the longitudinally directed metal strips can be a current distributing member. The ladder electrodes can be formed in any suitable width, preferably, about 8 inches to about 30 inches. The void space between lateral metal strips in the ladder electrode, generally, can be less than 1 inch up to about 6 inches or, preferably, about 2 inches to about 4 inches, most preferably, about 3 inches to about 4 inches. The spacing between adjacent, individual ladder electrodes placed on a concrete surface, generally, is a function of the amount of current required to cathodically protect the steel reinforcement members in the concrete. The required current density is a function of the density of the steel reinforcement members within the concrete structure. For variable current density, this spacing between adjacent ladder anodes can be from less than 1 inch to about 6 inches, preferably, about 3 inches to about 6 inches, most preferably, about 3 inches to about 4 inches.

The amount of electrical current which is applied to a cathodically protected steel rebar may be described in terms of current density (CD), i.e., the amount of current per unit of surface area. There are three different surface areas that may be specified for the current density. Typical values for the particular type of current density are as follows:

CD (steel)—the current per unit surface area of the steel rebar, generally, about 1 to about 3 ma/ft$^2$, CD (concrete)—the current per concrete deck surface area, generally, about 1 to about 3 ma/ft$^2$, and CD (anode)—the current per activated (catalyzed) titanium anode surface area, generally, about 5 to about 10 ma/ft$^2$.

CD (anode) is specified by the corrosion engineer who has designed the CP system. On the one hand, it should be high, to reduce the amount of anode surface which is needed. On the other hand, it must have a maximum value (usually set at about 10 ma/ft$^2$) because too high a current density may lead to unwanted electrochemical reactions at the anode surface. CD (concrete) is also set by the corrosion engineer, and it will vary depending on the amount of steel rebar embedded in the concrete and the ambient corrosion conditions in the concrete (degree of humidity, temperature, aggressive ion concentrations, etc.) A high density of steel rebar in the concrete will impose a requirement for more current per unit area of concrete.

In order for the ladder anode system of the invention to have a variable CD (concrete) so as to encompass varying specifications imposed by the density of the steel rebar present in the concrete article, the ladder anode can be installed onto the concrete article surface and covered with an ion conductive overlay. As shown in the table below, variable spacing between the ladder anodes provides a means of varying the current density. When the ladders which are nominally 12 inches wide, are spaced 4 inches apart, this will be equivalent to a center-to-center spacing of 16 inches.

TABLE I

CHARACTERIZATION TABLE FOR SPACING

| SPACING: CENTER TO CENTER, Inches | NUMBER OF NODES; Number/m$^2$ | VOID SPACE % | WEIGHT: Kg/m$^2$ concrete | CD (con-crete) ma/ft$^2$ |
|---|---|---|---|---|
| 18 | 57 | 92.6 | 0.14–0.17 | 1.6 |
| 16 | 65 | 91.7 | 0.16–0.20 | 1.8 |
| 14 | 74 | 90.5 | 0.18–0.22 | 2.1 |
| 12 | 86 | 88.9 | 0.21–0.26 | 2.4 |

* The CD (concrete) values are calculated assuming that the CD (anode) value has been specified as 10 ma/ft$^2$ of anode surface. Void space is defined as the percentage of open area relative to the total area of the anode structure when the anode structure is laid on a flat surface and viewed from above.

The ladder anode allows more versatility in concrete current density than the prior art. In order for cathodic protection of steel reinforcement (rebar) to take place most efficiently, the correct amount of current must be applied to the rebar. Too little current will not properly protect the steel from corroding, and too much current will not properly protect the steel from corroding, and too much current will waste either electrical current or valuable titanium electrode material. More importantly, too much current could change the electrochemical reaction characteristics at the anode, such that the chlorine evolution reaction may be substituted for the oxygen evolution reaction. Chlorine evolution would have a disastrous effect on the integrity of the concrete structure.

For a CP system installation, it is best to use the correct amount of titanium anode, no more (extra cost) and no less (insufficient protection of the rebar) to supply the correct amount of current. An optimum current density on the anode surface is, generally, about 10 ma/ft$^2$—(higher and one risks chlorine evolution and shortened anode lifetime; lower and one does not efficiently use the relatively expensive titanium anode). One should be able to vary the amount of anode on the concrete surface to obtain the correctly desired concrete current density. If, for instance, the correct concrete CD is 2.1 ma/ft$^2$, one would use a 14" center to center spacing as suggested in the Table for a ladder anode operating at 10 ma/ft$^2$. For a desired 1.8 ma/ft$^2$ concrete CD, one would use a 16" center to center spacing. In other words, the spacing can be adjusted for any normal requirement of concrete surface current density for the protection of embedded steel reinforcing bar.

In contrast, if one were to use a highly expanded, titanium mesh anode as is presently commercially available, one would use the type 210 anode mesh for both the 2.1 and the 1.8 ma/ft$^2$ CD requirements. For the 1.8 ma/ft$^2$ service, one would not be using the anode material efficiently, since it is designed specifically for a higher CD, and there is no possibility for variation in the expanded mesh structure in order to make it "fit" the requirements more properly. If one were to try to use the next lower surface area anode, the type 150 mesh, one would be forced to increase the anode surface CD beyond the recommended limit of 10 ma/ft$^2$.

For an embedded titanium anode, the lengthwise electrical resistance is of importance because a lower resistance will generally require fewer titanium conductor bars to be used. The use of fewer conductor bars means reduced material cost and, more significantly, less labor for laying out and attaching the conductor bar to the anodes. The specifications for the electrical resistance for the three expanded mesh anodes referred to earlier were reviewed and compared with the equivalent values for the ladder anode as described in the Example. The table below summarizes the data.

TABLE II

LENGTHWISE ELECTRICAL RESISTANCE FOR VARIOUS ANODES

| CONCRETE CURRENT DENSITY REQUIRED, ma/ft$^2$ | EXPANDED MESH RESISTANCE, OHM/FT | LADDER ANODE RESISTANCE, OHM/FT |
|---|---|---|
| 1.5 | 0.026 | 0.015 |
| 2.1 | 0.014 | 0.010 |
| 3.0 | 0.008 | 0.007 |

From the table, it can be seen that the ladder anode in each case offers lower electrical resistance than the equivalent expanded mesh anode. This is so even though only one version of the ladder anode is provided whereas three difference versions of highly expanded mesh were available to satisfy the concrete current density requirements. This table further shows the versatility of the ladder anode to encompass different CD requirements and still provide a better resistance specification than the commercially available prior art anodes.

In order for an impressed current anode embedded in concrete for the cathodic protection (CP) of steel reinforcing bar to work properly, the proper current per unit of anode surface area (current density, CD) must be applied. Too high a CD (depending on the ambient conditions at the anode to concrete interface) generally high than about 100 ma/ft$^2$ of the anode surface, may lead to a significant amount of chlorine evolution instead of oxygen evolution at the anode surface. As well, too high a CD will have a detrimental effect on the lifetime of the anode. Too low a current density will require so high an anode surface area to protect the steel from corrosion, as to be unachievable by currently known anode materials. It is now generally accepted that an average CD in the region of 5 to 10 ma/ft$^2$ of anode surface is a good compromise for a reasonable CD from available anode structures without being too high.

Because embedded impressed current anodes for steel rebar CP are, generally, made of titanium as the electrode substrate, and titanium is a relatively expensive material, there are limitations on the amount of electrode substrate metal that may be used for a cost effective CP system. One must design a titanium anode to have as high a surface area as possible to provide about 5 to 10 ma/ft$^2$. The anode must be able to distribute the current uniformly over a wide area of the concrete structure. Furthermore, the titanium structure must not be too costly to manufacture.

Titanium flat stock, such as sheet and plate, is generally fabricated by rolling. Because titanium also work hardens, there is generally an annealing step between rolling steps to obtain thinner material. Titanium ribbons are generally made by slitting thin, rolled, titanium sheet stock. On the other hand, small diameter wire stock such as round, oval, or square wire, must be manufacture by extrusion or drawing. Because of the toughness and work hardening of titanium, the manufacture of titanium wire stock is much more costly on a per weight basis than that for flat stock. For example, commercially pure titanium flat stock can be obtained for prices in the range of about $9 to $16 per pound. Wire stock is usually priced in the range of about $25 to $40 per pound. These prices will depend somewhat on normal availability and quantity. However, it can generally be said that wire stock will be more than twice as costly as flat stock of similar metal cross-section.

The ladder anode longitudinal and lateral strips are generally manufactured rectangular shaped titanium ribbon material of about 0.004 to 0.005 square inch cross section. The lower limit (not easily handled or not economically available) would be about 0.003 square inches (0.2" wide by 0.015" thick). The upper limit (too thick—not enough surface area per weight; or too wide—does not allow good bonding of concrete grout around the strip) would be about 0.006 square inch. The substrate materials of equivalent cross-section in the form of round wire would have diameters in the range of 0.05 to 0.09 inch.

The rectangular shaped longitudinal and lateral strips of the ladder anode have relatively large surface areas per unit of weight. Given a longitudinal strip width of 0.205 inch and a thickness of 0.020 inch, the surface area in one linear foot of this material is 5.40 square inches. Since the weight of such a strip in a 12 inch length is 0.0080 pounds, the surface density, defined as the surface area per unit weight, is 673 square inches per pound. For the lower limit of cross-section (0.20 inch by 0.015 inch), the surface density is 879 square inches per pound. For the upper limit of cross-section (say, 0.24" by 0.25") the surface density is 542 square inches per pound. The practical limitation is a surface density of 500 to 900 square inches per pound of titanium. This limitation will apply to the preferred forms of the strips making up the ladder anode of this invention.

Substitution of a round wire cross-section as a possible substrate for the wire diameter of 0.05 or 0.09 inch would result in a surface density, respectively, of only 491 or 273 square inches per pound.

For the expanded mesh structures of the prior art, the strand dimensions may be up to 0.2 cm width by 0.125 cm thickness (see e.g. U.S. Pat. No. 4,900,410 Col 12, lines 45–48). These dimensions convert to a cross-section of 0.079 inch by 0.049 inch which is equal to 0.0039 square inch, and a low surface density, i.e., surface area per unit of weight of only 406 square inches per pound of titanium and thicker cross-sections at the mesh nodes would make the surface density even lower.

The design specifications of three commercially available expanded mesh anode materials made out of titanium were reviewed, and the anode surface densities were calculated and compared to that for the ladder anode of this invention. The results are shown in the table below.

TABLE III

Anode Surface Densities for Various Titanium Anodes

| Anode Type | Elgard 150 | Elgard 210 | Elgard 300 | Ladder Anode |
|---|---|---|---|---|
| Surface Density* | 386 | 403 | 455 | 653 |

*Anode surface area in square inches over one square foot of concrete

The ladder anode has a significantly larger surface density than the expanded commercially available, mesh anodes. This larger surface area represents a significant increase in the efficiency of use of the titanium material for the anode substrate relative to the highly expanded mesh anodes of the prior art shown in table III.

In the prior art highly expanded mesh anodes, the current applied per unit of concrete surface is not variable at a fixed anode surface current density because the anode mesh has an invariant form over the length and width of the roll. Thus, at least three different sizes of the prior art mesh need to be manufactured, stocked, and purchased, in order to have some flexibility in current density when applied to a concrete structure. As previously described and set forth in table I, the ladder anodes of the invention can be applied so as to encompass varying current density requirements imposed by the density of the steel rebar present in the concrete article merely by installation of the ladder anodes onto the concrete with variable spacing between individual ladder anodes. This provides flexibility in current density which is not attainable with the prior art anodes.

In another prior art anode design, ribbon mesh strips are laid out onto the concrete surface in a density commensurate with the current requirements of the rebar in the structure. Then the ribbon mesh strips are welded together to form a grid anode. Not only is this a labor-intensive process, but also the ribbon mesh strips are difficult to handle because they tend to roll or turn over on the surface of the structure, especially when the strips are placed in precise positions with respect to each other in the two horizontal directions. Although the ribbon mesh lay-out is completely variable, this prior art method is very costly to put into place because of the large amount of field labor for material lay-out, fixing to the concrete surface, and welding of the strips, that must be used.

The ladder anode of the invention is easy to handle as a roll, will not turn over on its width during rolling out, requires only a limited amount of spot welding in the field, and yet, because of the variable spacing of the anode ladders, complete variability of current density commensurate with the normal rebar density is allowed.

One of the significant advantages of the ladder electrode of this invention whether formed of non-porous or porous metal strips which are elongated or expanded in a direction normal to the largest surface area of the strip, is that the metal strips of the ladder electrode of the invention can be formed of titanium using either a grade 1 or grade 2 titanium. In the prior art, the use of grade 1 titanium has been considered desirable to form an expanded metal structure which is expanded in a direction of the plane of the largest surface of the metal strip because of the, generally, greater expansion ratios utilized. The use of grade 1 titanium allow the expansion process to be performed without excessive breakage of the strands of the expanded mesh. Grade 1 titanium is more suitable for preparing such expanded metals as having a lower tensile strength as well as a higher purity than grade 2 titanium. However, the higher cost and reduced availability of grade 1 titanium has necessitated very high expansion ratios in order to provide an economical but necessarily weaker expanded mesh structure than can be provided by the use of a grade 2 titanium which is not only less expensive but more readily available.

The ladder anode is easy to handle in the field. The highly expanded titanium mesh anodes of the prior art are very flexible, so flexible that they easily take on bulges, kinks, and other unwanted deformations. Because of this, the mesh must be unrolled with great care to avoid snags. This is a significant deficiency of the highly expanded mesh system. Installation workers in the field find working with the mesh troublesome during the installation process. The process of unrolling of the mesh often causes snags because of the sharp, free strands at the edges of a roll. The sharp points at the edges of the strands require that the installer wear gloves for personal protection from frequent cuts and punctures. The frequently occurring snags can cause deformations of the mesh. In addition, significant care must be taken by workers during installation or pouring of the concrete overlay. Shoes and boots are easily caught on the mesh, causing further deformations that must be flattened and fixed to the concrete surface. Catching of footwear or machinery in the field can even cause breaks in the mesh which must be repaired. It has been recognized that these deformations occur. Accordingly, standard installation procedures require that the mesh be stretched to remove them before fixing the mesh to the concrete surface. However, during the stretching procedure, the area of anode surface on the concrete is reduced in an uncontrolled manner. Thus, an unwanted variation in the current density may be inadvertently obtained.

The ladder anode of the invention is flexible only in the direction of the roll. It does not snag because there are no sharp points at the edges. There is less danger of cuts and punctures when the anode is handled in the field. The anode cannot be stretched, and thus the surface area of the anode on the concrete surface is known and invariant for each piece of ladder anode. The spacing of the ladder anodes is then varied in a very specific way to obtain the required current density that is specified. There is no uncontrolled stretching or changing of the anode surface area relative to the concrete surface and because the ladder anode cannot be stretched, there occurs no unwanted bulging or deformations above the plane of the concrete surface as a result of installation handling. In the vast majority of concrete structures, the anodes are installed on flat or reasonably flat surfaces, such that stretchability to eliminate deformations is not an advantage, but is rather a disadvantage in allowing the deformations to occur. The ladder anode can be bent, to turn around corners, if such is required, because the strips have relatively thin cross-sections. However, because the ladder anode is not flimsy or stretchable, it is more easily held in place during installation.

The ladder anode of the invention can be made from ASTM B-265 grade 2 titanium. In order for the expanded mesh of the prior art to be manufactured without breaks in the strands or knots, a very high elongation and low yield strength are necessary. Thus, the ASTM B-265 grade 1 titanium is necessary for producing the highly expanded prior art titanium mesh. Because the usual form of the ladder anode is not made of an highly expanded strip mesh, the titanium substrate for the longitudinal and lateral strips of the ladder anode need not be made of grade 1 titanium. This is important commercially because grade 2 titanium is more often less expensive, but more importantly, it is usually more readily available than grade 1 titanium. Because the ladder anode can be made from either grade 1 or grade 2 titanium, the ladder anode is more commercially desirable as allowing more flexibility in price and delivery of the titanium raw material.

The ladder anode longitudinal and lateral strips, preferably, have thin rectangular cross-sections. Although a ladder anode can be made with strips with other cross-sectional shapes, a rectangular shape is required for the cathodic protection of steel rebar in concrete. For long term operation, one must have a reasonably low current density on the anode surface, so that the catalyst will operate for a long time, and so that the correct electrochemical reaction (oxygen evolution) occurs as the only reaction. However, one must also have enough current in order to protect the steel. With these restrictions, the anode must have a large surface area per unit of weight. The large surface area is provided by a very thin material which provides a large surface area for a minimum rectangular shaped amount of titanium mass. If the same mass of titanium in the ladder anode were formed of circular shaped strips, then the surface area of the strips would be so low as to make the usefulness of such a ladder anode severely limited.

I

The ladder anode of one embodiment of the invention is formed, preferably, of titanium having an oxide film on the surface thereof and can be formed of porous or non-porous intersecting, electrically connecting, metal strips forming nodes at the intersections of said strips and is free of electrocatalytically active metal coatings which have been applied in the prior art to metal electrodes, particularly titanium substrates for use as anodes in cathodic protection systems. The ladder anode in this embodiment of the invention does not require the application of an electrocatalytic metal coating or a precursor electrocatalytically active metal coating and the subsequent activation of said catalytic coating.

Surprisingly, it has been found possible to extend the lifetime of a titanium ladder anode, as determined by exposure of the ladder anode to accelerated testing, by heating the metal anode at elevated temperature. Generally, exposure of the metal of the anode grid to a temperature of about 250° C. to about 750° C. for a period, generally, of about 3 minutes to about 5 hours, preferably, about 30 minutes to about 3 hours, and most preferably, about 1 hour to about 2 hours results in a substantial improvement in anode lifetime. The time before passivation occurs at a given current density is thus extended. In use, the ladder anode in this embodiment of the invention is connected to a source of direct current and the circuit is completed by connecting as a cathode the reinforcing elements, i.e., steel bars within the concrete structure. The impressed current is opposite and at least equal to the naturally occurring current which results under normal circumstances. The net result of impressing a direct current which is opposite and equal to the naturally occurring current is to prevent electrolytic corrosion action on the reinforcing steel bars.

Titanium and alloys comprising titanium and up to 10% by weight of another metal are useful. Titanium is readily available and relatively inexpensive when compared with the other valve metals. Preferably, the titanium is ASTM B-265 titanium grade 1 or 2.

Titanium when exposed to normal atmospheric conditions will inevitably possess a surface oxide layer for example, titanium oxide ($TiO_2$) which can be stoichiometric or non-stoichiometric depending upon the conditions of formation of the oxide layer. The titanium strips forming the ladder anode of the invention are believed to have a surface oxide layer which is stoichiometric as represented by the compounds $TiO_2$, TiO, and $Ti_2O_3$. Accelerated tests indicate that the lifetime of the electrode can be substantially extended by activating the electrode at elevated temperatures. It is considered that this process results in the formation of a surface oxide layer which is stoichiometric.

The novel ladder electrode can be formed by electrically connecting intersecting titanium strips. The ladder anodes can be formed of a plurality of metal strips having trough and crest nodes or protrusions defining upper and lower planes at the extremities of said nodes as shown in FIGS. 8–13. The nodes of the metal strip can be spaced longitudinally to provide an intermediate plane separating the upper and lower nodes. The trough and crest nodes, in a preferred embodiment, alternate both laterally and longitudinally. The metal ladder anodes of the invention are electrically connected at intersecting strip areas, such as by welding.

The use of the titanium ladder anode without an electrocatalytically active metal surface in a cathodic protection system for reinforced steel elements in concrete is limited to those applications where the anode current density is controlled at up to about 20 milliamps per square foot unless the metal is activated by heating at an elevated temperature. Generally, the ladder anodes of this embodiment of the invention can be prepared from a metal such as grade 1 or grade 2 titanium which normally has an oxide film on the surface thereof. Preferably titanium is activated prior to use as an anode so as to extend the lifetime of the anode and allow use of the anode at higher anode current densities. Activation can be accomplished by heating the metal anodes at elevated temperature as previously described. Preferably, activation is accomplished by exposure of the metal to a temperature of about 250° C. to about 750° C., preferably, for a period of about 3 minutes to about 5 hours. Upon activation a substantial improvement in anode lifetime occurs, as indicated by the time for passivation of the anode to occur at a given anode current density.

Ladder anode current densities of up to about 20 milliamps per square foot can be used with the titanium anode of the invention not coated with an electrocatalytically active metal coating. Preferably, cathodic protection systems in which steel reinforcing elements are embedded in concrete are, generally, operated at an anode ladder current density of about 0.1 to about 15 milliamps per square foot, most preferably, an anode current density of about 2 to about 10 milliamps per square foot. As indicated above, an extension of the lifetime of the metal anode can be obtained by heating the anode. Upon heat activation of the ladder metal anode, anode current densities of up to about 50 milliamps per square foot can be used, preferably, about 10 to about 20 milliamps per square foot.

II

Where the novel ladder anode of the invention is formed of strips of a composite comprising a titanium base and an electrocatalytically active metal coating thereon, cathodic protection systems can be operated at substantially higher current densities such as up to about 80 to about 120 amperes per square foot.

The application of an electrocatalytically active metal coating on the surface of a metal substrate can involve painting or spraying an aqueous or organic solvent solution of a soluble precursor compound on the surface of the metal. Application of the precursor catalyst compound can also be made by electrolytic and electroless plating and by thermal spraying. Thermal spraying is defined to include arc-spraying as well as plasma and flame spraying. The electrocatalytically active metal can also be applied by thermal spraying of a metal or metal composite. Subsequent to application of a precursor compound, the coating is heated to convert the precursor compound to the electrocatalytically active metal form such as the oxide. Thermally sprayed coatings may not require heating to convert the catalytic coating to the catalytically active metal form.

The physical form of the electrocatalytically active metal coated ladder electrode is similar to that described above for the ladder electrode not having an electrocatalytically active metal surface, i.e., metal strips having a plurality of trough and crest nodes, as shown in FIGS. 8–13; metal strips as shown in FIGS. 1–7; expanded metal strips as disclosed in the prior art and non-porous metal strips. Where higher current densities are used with the electrocatalytically active metal coated ladder electrode, it will be recognized by one skilled in this art that a larger number of anode strips or thicker or wider anode strips will be used to form the ladder electrode.

Typical catalyst precursor compounds used to apply liquid solution coatings and thermal spray coatings consist of at least one platinum group metal compound selected from the group consisting of metal compounds of platinum, palladium, ruthenium, rhodium, osmium, iridium, or mixtures or alloys thereof. Cobalt, nickel, and tin compounds can also be utilized as electrocatalytic precursor compounds. The precursor compounds are heated to convert these or a portion of these compounds to their oxides so as to provide a coating of at least one platinum group metal or other catalytic metal, as set forth above. Preferably, two or more platinum group metals are used to form the coating.

The titanium strips can also be coated with a composite of a catalytic coating either before or after forming into porous or non-porous strips before or after being assembled in ladder form. Usually before coating, the metal will be subjected to a cleaning operation, e.g., a degreasing operation, which can include cleaning plus etching, as is well known in the art of preparing a metal to receive an electrochemically active metal coating. The electrochemically active metal coating composite can comprise a valve metal or oxides or alloys thereof and at least one electrocatalytically active metal or oxide thereof, or it can be any of a number of active oxide coatings alone or in admixture with a valve metal or alloy or oxide thereof. Active oxide coatings such as the platinum group metal oxides, the oxides of tin, nickel, manganese, or magnetite, ferrite, cobalt spinel, or other mixed metal oxide coatings are useful. Such coatings have been developed for use as anode coatings in the industrial electrochemical industry for an oxygen evolution reaction. The valve metal alloy can contain up to 10 percent by weight of an alloying metal. It is particularly preferred for extended life protection of concrete structures that the anode coating be a mixed metal oxide, which can comprise a solid solution of a titanium metal oxide and a platinum group metal oxide.

For the extended life protection of steel reinforced concrete structures, the coating should be present in an amount of from about 0.05 to about 0.5 gram of at least one platinum group metal per square meter of electrode strip. Less than about 0.05 gram of at least one, preferably two or more platinum group metals platinum group metal will provide an insufficient electrochemically active metal coating for preventing passivation of the metal substrate over extended time, or to economically function at a sufficiently low single electrode potential to promote selectivity of the anodic reaction. On the other hand, the presence of greater than about 0.5 gram of at least one platinum group metal per square meter of the electrode strip can contribute an expense without commensurate improvement in anode lifetime.

In this embodiment of the invention, the mixed metal oxide composite coating is highly catalytic for an oxygen evolution reaction. The platinum group metal or mixed metal oxides for the coating are such as have been generally described in one or more of U.S. Pat. Nos. 3,265,526, 3,632,498, 3,711,385 and 4,528,084. More particularly, such platinum group metals for forming the composite include platinum, palladium, rhodium, iridium and ruthenium or alloys with other metals and the titanium for forming the composite include titanium, tantalum, zirconium, niobium, and alloys and mixtures thereof. Mixed metal oxides comprise at least one of the oxides of these platinum group metals in combination with at least one oxide of titanium or an oxide thereof and another non-precious metal such as the oxides of tin, nickel, cobalt, and manganese.

The three-dimensional structure of the expanded metal strips shown in FIGS. 1–13 in use in a concrete structure allows the distribution of the electrical current in multiple planes in the concrete. To obtain this three-dimensional current distribution, both the anode ladder structure and the electrical current must not be concentrated in one plane. With a three-dimensional structure, there is less likelihood of any subsequent delamination of the usual concrete overlay as a result of the anode presence in the concrete structure. With the prior art expanded mesh structures, for instance there is a greater tendency for the concrete overlay to separate from the underlying concrete.

The distribution of current from the surfaces of the anode to the steel rebar depends upon the proximity of the ladder anode surfaces to the rebar. If the anode ladder is placed between two mats of steel rebar, then the current will emanate, generally, from both sides of the anode strands, and particularly from the surfaces in the planes of the crest and trough nodes of the metal strips of FIGS. 8–13 or the planes defined at the upper or upper and lower louver surfaces of the metal strips of FIGS. 1–7. The amount of current emanating from these surfaces will tend to be greater than the amount of current emanating from the essentially flat expanded metal grid anodes of the prior art in which the current from the plane of the expanded mesh structure emanates equally from the crossing and connecting strands; that is, the current would tend to be more evenly distributed.

Figure 1:
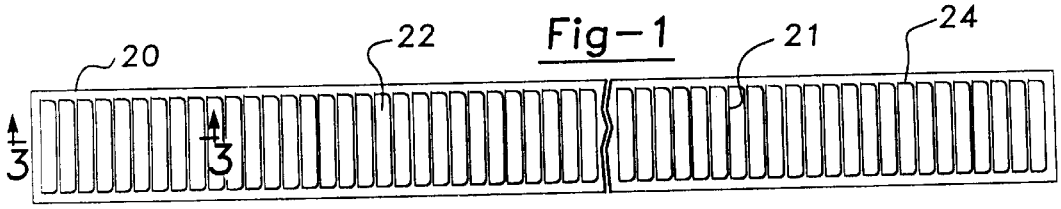
FIGS. 1–13 illustrate several examples of porous metal strips utilized to form the ladder electrode of the invention shown in FIG. 14. Non-porous metal strips can also be used to form the ladder electrodes of the invention. The porous metal strips are formed by slitting and subsequently expanding a metal strip in a direction normal or parallel to the largest dimension of the metal strip. Each of these metal strips can be formed into the ladder electrode of the invention by electrically connecting the metal strips at the intersections of the strips. Alternatively, mixtures of the various examples of metal strips, including non-porous, metal strips can be utilized to form the ladder electrode of the invention.
Figure 4:
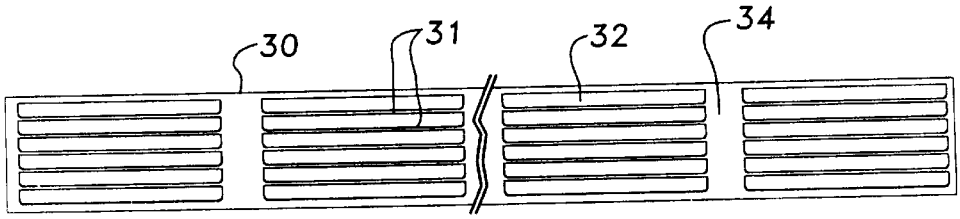
Figure 7:
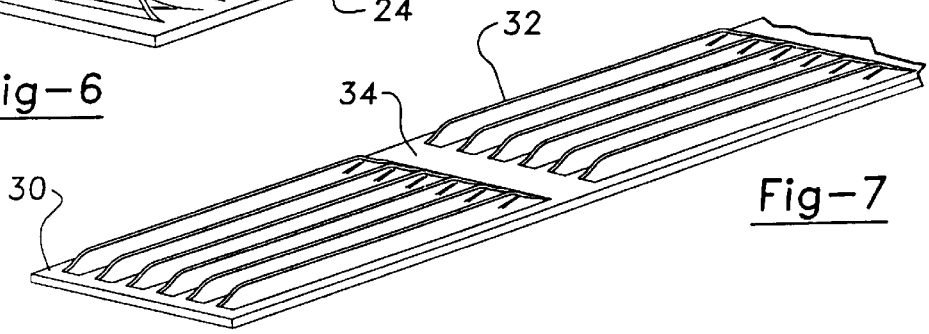

When the metal strips forming the ladder electrode of the invention are characterized by a plurality of louvers, as shown in FIGS. 4, 5, and 7, arranged in multiple louver units and aligned in the long dimension substantially parallel in a longitudinal direction of the metal strip from which they are formed, each louver defines upper or upper and lower planes at the lateral extremities of said louvers. Multiple louver units are spaced from adjacent units by an intermediate plane. A series of multiple louver units aligned as indicated above have the same or alternating angles of about 20° to about 90° to said intermediate plane. In addition to the parallel or perpendicular alignment of the louvers in the long dimension in a longitudinal direction of the metal strip, as shown in FIGS. 4 and 1, respectively, the louvers can be oriented on the metal strip at any angle between 0 and 90° to the longitudinal direction of the metal strip.

When the metal strips forming the ladder electrode of the invention are characterized by a plurality of substantially parallel louvers, as shown in FIGS. 1–3, and 6, and aligned in a lateral direction on said metal anode strip, each louver can define upper and lower planes at the extremities of said louvers. Said louvers are bordered at their lateral extremities by an intermediate plane. The strips are, generally, formed using an electrocatalytically active metal coated metal. The strips can also be coated with an electrocatalytically active metal after forming or after a ladder structure bonded at the intersections of said metal strips is formed. Where the metal is coated with an electrocatalytically active metal layer, it is preferred that the coating comprise a mixed oxide of a platinum group metal and titanium or a mixed platinum group metals or oxides thereof, as set forth above.

In the example of a metal strip shown in FIG. 7, the metal strip is characterized by a plurality of louvers arranged in multiple louver units and aligned in the long dimension substantially parallel to the longitudinal direction of the metal strip. The louvers can define upper and lower planes at the lateral extremities of said louver units. The louver units are spaced from adjacent louver units by an intermediate plane. In another example shown in FIG. 6, the metal strip is a plurality of substantially parallel louvers aligned laterally in the long direction on the strip. The ladder anode is formed with said strips, said louvers defining either upper or upper and lower planes at the lateral extremities of said louvers. Said louvers are bordered at their lateral extremities by an intermediate plane.

Figure 6:
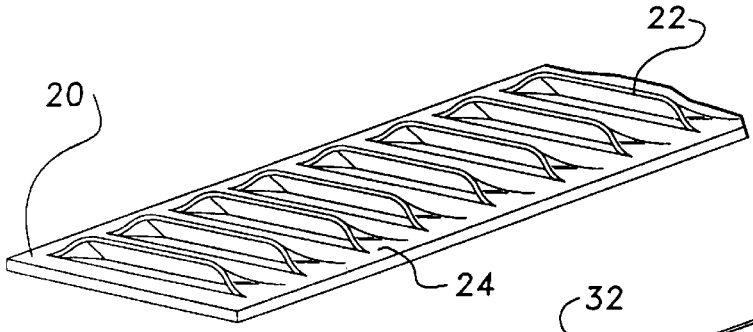

While each of the examples of metal strips described above in FIGS. 6 and 7 are useful, it is preferred to utilize the metal strips of the example shown in FIG. 7 so that electrical conductivity along the metal strip will not be compromised or at least reduced very little. Orienting the louvers of the valve metal strip laterally as in the metal strip example shown in FIG. 6 is less desirable with respect to electrical conductivity of the ladder anode.

In another example not shown in the Figures, the multiple louver units define only an upper plane at their upper extremity; the lower extremity coinciding with the plane of the metal strip from which the anode is formed.

The openings formed by the louvers of these metal strips are large enough to allow a concrete grout to flow through such openings. Preferably, a minimum opening formed by the louvers is about 1/16 of an inch in dimension, more preferably, about 3/32 of an inch to about 1/8 of an inch. On the other hand, the louvers are not so large that, when they are formed by twisting the louver slats out of the plane of the starting strip of metal, they do not form a plane or planes which extend so as to be inadequately covered in use by the usual concrete overlay. Preferably, the anode ladder profile when viewed from the side is less than about ½ inch.

The length of the louvers of the titanium strips is less critical than the dimensions set forth above. Generally, the length of the louvers can be about ½ inch to more than 3 or 4 inches in the embodiment of FIG. 7 depending somewhat upon the width of the anode strip. Giving due consideration to the width and thickness of a particular louver slat, the length of the louver slat is not so great that the rigidity of the metal strips is compromised, that is, not so great that the metal strips would not retain the original orientation under normal handling or installation procedures. In addition, the length of the louver slat, if oriented along the length of the starting anode strip, as in the embodiment of FIG. 7, is not so great that upon rolling up the louvered ladder anode, an inordinately large diameter roll would result.

The louvers shown in FIGS. 1–7 are formed by slitting a strip of titanium then twisting the slit strips into final orientation so as to form an angle with the base plane of the anode strip from which it is formed in which the angle of the louvers is at least about 20° to the plane of the original anode strip, preferably, at least about 70° to about 90° to said plane. The louvers can be oriented so that succeeding groups of louvers are turned in an alternate direction or the louvers can all be oriented in the same direction.

With respect to the example of the metal strip shown in FIG. 7, the louvers define either upper or upper and lower planes at the lateral extremities of said louvers. Intermediate between the upper and lower planes is the original base plane of the metal strip. The base or intermediate plane separating the series of louver groups can vary in longitudinal dimension but in order to maintain the ability of the metal to accommodate the penetration of concrete grout and to increase the effective metal surface area, the intermediate plane, generally, is not more than about 2 inches in longitudinal dimension, preferably, less than 1 inch in longitudinal dimension, and, most preferably, about ⅜ of inch to about ¼ of an inch in longitudinal dimension.

The titanium anode ladder strips can be formed using conventional metal working equipment such as a piercing die to perforate the metal strip in preselected portions and a die mechanism to impart the final shape to the louvers which can project both above or both above and below the base plane of the metal strip from which the anode ladder is formed. In certain instances, the piercing and shape forming operations can be completed with the same dies.

Referring now to the drawings in greater detail, in FIG. 1, there is shown one embodiment of a titanium strip in a plan view. Flat sheet stock metal strip 20 is slit laterally at 21 so as to define louvers 22 which are formed by twisting the slit sheet stock so as to form louvers which are inclined at an angle of at least 20° to the plane of the flat sheet stock metal. Bordering the longitudinal extremities of said louvers is plane 24 which is intermediate between the planes defined by the lateral extremities of louvers 22 which upon twisting extend both above and below the intermediate plane of the flat strip metal material.

Figure 3:
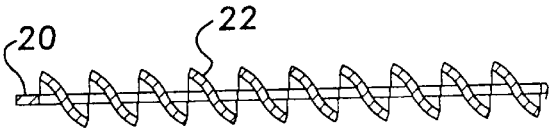

In FIG. 2, there is shown in a side view a titanium strip having metal strip 20 and louvers 22 shown in a plan view in FIG. 1. An enlarged side view through section 3—3 is shown in FIG. 3 in which louvers 22 project both above and below the plane of metal strip 20.

In FIG. 4, there is shown in a plan view another embodiment of a titanium strip used to form the ladder anode of the invention in which a flat sheet stock metal strip 30 is slit longitudinally so as to allow louvers 32 to be formed by twisting sections defined by adjacent slits 31 in the flat sheet stock material. The louvers are raised by twisting the slit sheet stock to form a series of louver units oriented at an angle of at least 20° to the plane of the flat sheet stock material. Where the louvers project both above and below the surface of the metal strip from which they are formed, the louvers define at their lateral extremities upper and lower planes. The louvers can also project only above the surface of the metal strip from which they are formed. An intermediate plane 34 separates successive louver units.

In FIG. 5, there is shown in a side view the titanium strip shown in a plan view in FIG. 4. It is noted that in each of these examples the louvers 32 are formed from flat sheet stock metal strip 34 without contracting or stretching the material longitudinally or laterally. Thus, the thickness as well as both longitudinal and lateral dimensions of the flat sheet stock metal strip remain essentially unchanged.

In FIGS. 6 and 7, there are shown isometric views of the titanium strips shown, respectively, in plan view in FIGS. 1 and 4. In FIG. 6, flat sheet stock metal 20, louvers 22 and intermediate plane 24 are shown. In FIG. 7, flat sheet stock 30, louvers 32, and intermediate plane 34 are shown.

Figure 8:
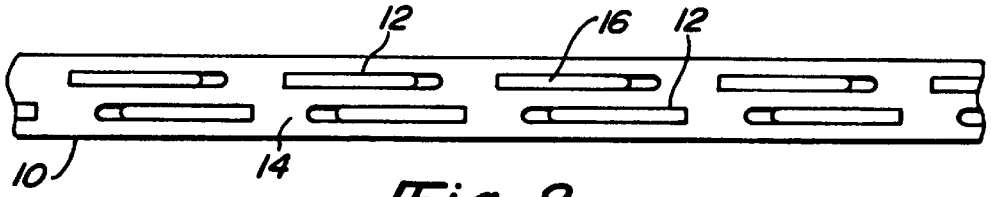

In FIG. 8, there is shown another embodiment of the metal strip used to form the ladder anode of the invention in which a metal strip 10 is slit at 12 so as to define nodes 16 which are raised or lowered in a direction normal to the plane of the flat sheet stock. This plane is also defined as intermediate plane 14 in describing the geometry of the fabrication of the metal strip of the ladder anode of the invention. Perforated portions shown as at 12 are produced by shearing preselected portions of flat sheet stock material 10 in closely spaced relation of one to another thereby forming exposed edges on each side. Slit areas 12 are pierced in sheet 10 by means of a piercing die, which is not shown, or by other known means and expanded to produce the finished configuration of the inventive ladder anode. Slit areas 12 are symmetrically offset as laterally displaced rows which project slightly into longitudinally adjacent rows so as to provide an intermediate plane 14 as between slit areas 12. Nodes 16 are alternately raised and depressed to form, respectively, crest and trough nodes defining upper and lower planes at the extremities of said nodes. The nodes are formed from slotted areas by forcing these areas in a direction normal to the intermediate plane of the strip while contracting or foreshortening the material longitudinally. The lateral dimensions of metal strip 10 remain unchanged during formation of the strip.

Figure 9:
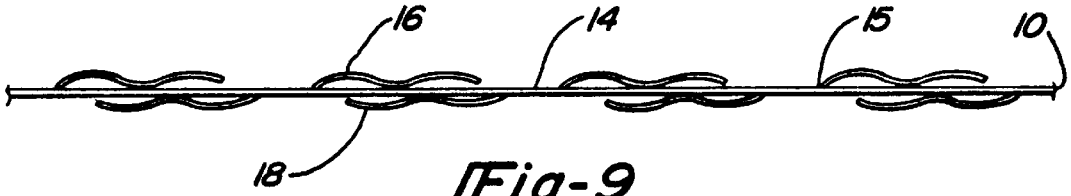

In FIG. 9, there is shown in a cross-sectional view the expanded nodes which are termed crests, upper node 16, and troughs, lower node 18, the expanded nodes 16 and 18 are longitudinally separated by intermediate planes 14 and are symmetrically staggered or offset and laterally displaced row on row and column on column with one node end attached to sheet stock material 10 at 15.

Figure 10:
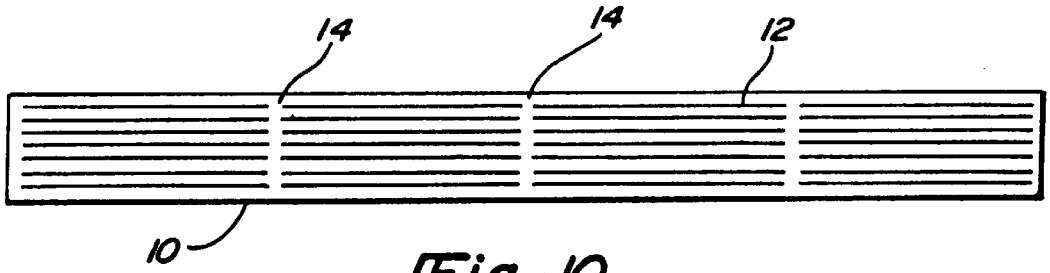

In FIG. 10, there is shown another embodiment of the titanium strip used to form the ladder anode of the invention. The strip is formed by first perforating metal strip 10 to provide a plurality of longitudinally aligned slit areas 12 separated by an intermediate area 14.

Figure 11:
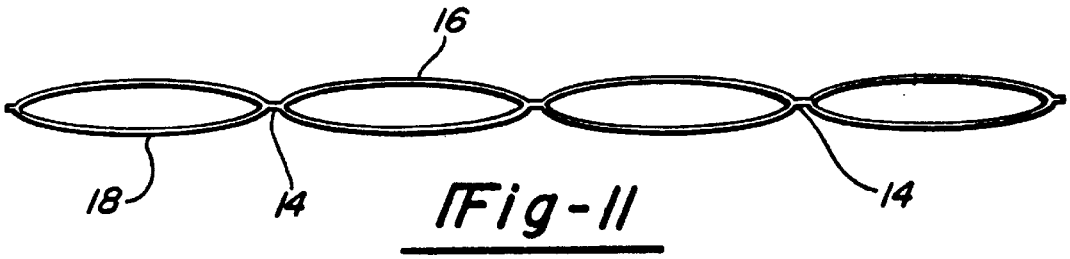

In FIG. 11, which is a cross-sectional view of the expanded metal strip shown in FIG. 10, upper node 16 and lower node 18 alternate both longitudinally and laterally and are separated by intermediate area 14.

Figure 12:
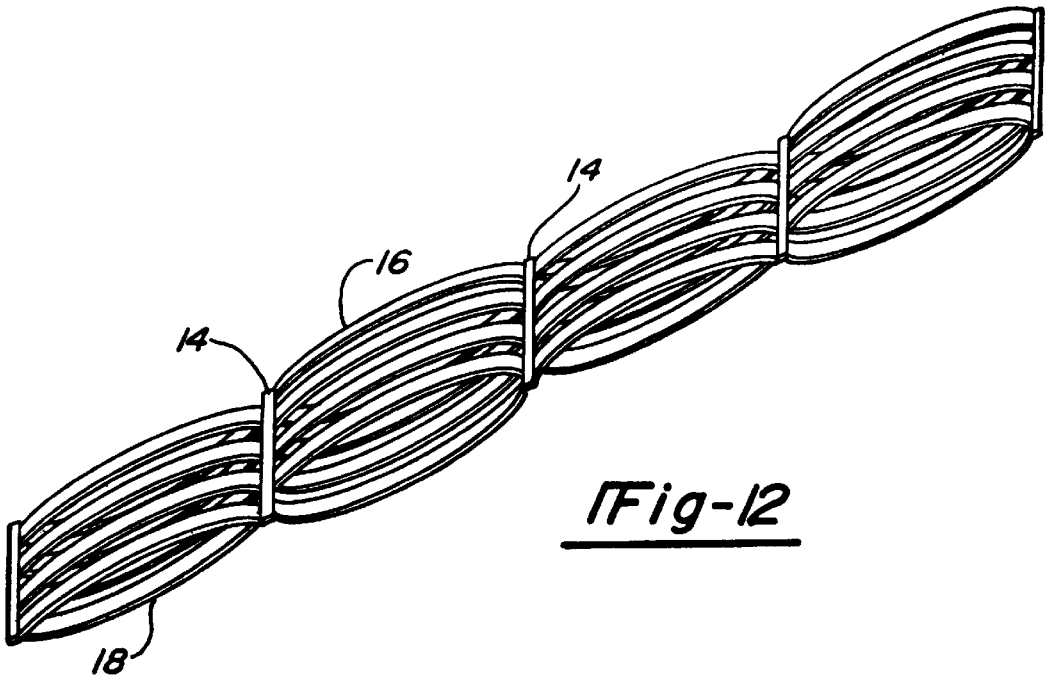

In FIG. 12, there is shown in an isometric view the embodiment of the metal strip shown in FIG. 11. Alternating trough node 18 and crest node 16 are separated by intermediate area 14.

Figure 13:
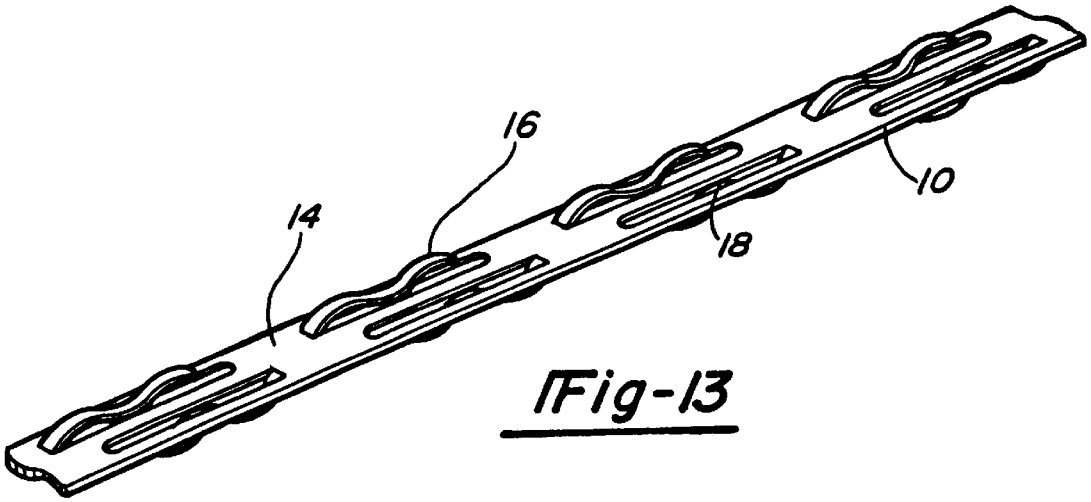

In FIG. 13, there is shown in an isometric view the embodiment of the metal strip shown in FIG. 9. The metal strip is formed from metal strip 10. Between upper node 16 and lower node 18 is intermediate area 14 which separates the successive crest node 16 and trough node 18.

Figure 14:
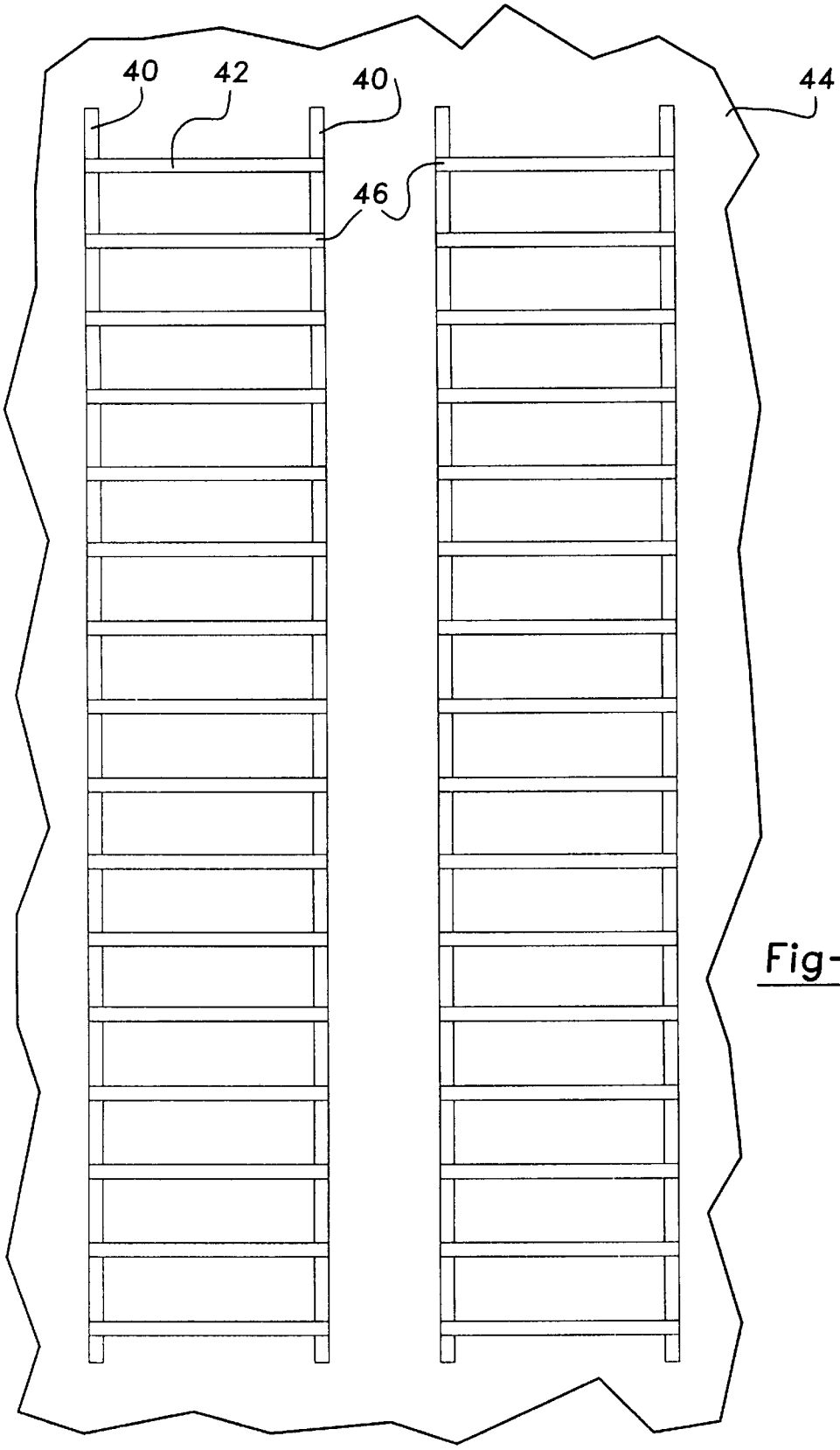
FIG. 14 is a diagrammatic representation of two ladder anodes placed upon a concrete surface. Strips forming the ladder can be either porous or non-porous, electrocatalytically coated metal or non-coated metal.

In FIG. 14, there is diagrammatically shown two individual ladder anodes of one embodiment of the invention placed upon a concrete surface 44. Longitudinally extending non-porous members 40 and laterally extending members 42 are electrically connected at intersecting areas 46 which are termed nodes. Current distribution members not shown can be placed at intervals laterally across the ladder anode to connect individual anode ladders.

Each current distribution member is preferably a strip of titanium either uncoated or coated with the same or different electrocatalytically active metal coating as the metal anode ladder strips and is electrically connected to the metal strips of the ladder electrode. In many installations such as parking garage decks and bridge decks, the current distributor strips can be advantageously bonded to the metal strips of the individual ladder electrodes with a spacing of between 10 to 50 meters. Such spacing is calculated to provide an adequate current density to the ladder electrode. In such installations, it is also a cost saving and convenient to have a common current distributor strip bonded to and extending across at least two individual longitudinally oriented ladder strips, for example, across two elongated ribbons of the ladder electrodes which have been rolled out side-by-side from two rolls of ladder electrode.

When the protected structure is a concrete deck covered by a series of side-by-side elongated strips of the ladder anode with a common current distributor strip extending across each ladder anode, the current distributor strip may conveniently extend through an aperture in the deck to a current supply disposed underneath the deck at a location where it is readily accessible for servicing, etc.

The protected structure can be, for instance, a cylindrical pillar having the ladder electrode covered by an ion-conductive overlay. The current distributor can in this case be a strip disposed vertically on the pillar and the ladder anode is cut to size so that it is wrapped around the pillar with little or no overlap.

The invention also pertains to a method of cathodically protecting steel pipelines placed in sea water, saline muds, or in the ground by supplying a continuous or intermittent current to a metal grid electrode placed in association therewith at a current density of up to about 120 amps per square foot. This current is effective for oxygen generation on the surfaces of the coated metal ladder anode and can be established by taking periodic measurements of the corrosion potential of the steel pipeline using suitably distributed reference electrodes in the proximity of the steel pipeline, and setting the operative current density to maintain the steel at a desired potential for preventing corrosion.

In the following example there are illustrated various aspects of the invention but this example is not intended to limit the scope of the invention. Where not otherwise specified in the specification and claims, temperature in degrees centigrade and percentages and parts are by weight.

EXAMPLE

A ladder anode is made from strips of ASTM B-265 grade 2 titanium according to the following dimensions.

Overall width to outer edges of longitudinal members: 12 inches

Number of longitudinal members in the ladder: 2

Longitudinal member thickness: 0.020 inch

Longitudinal member width: 0.205 inch

Center to center spacing between cross members: 3 inches

Cross member thickness: 0.020

Cross member width: 0.235 inch

Cross member length: 12 inches

The cross members are attached to the longitudinal members by resistance welding. The general form of the overall flat, finished structure approximate that shown in the schematic of FIG. 14. The ladder anode is catalyzed by coating with a catalyst precursor solution of a 70:30 mixture of platinum-iridium salts as is well known in the titanium anode prior art. The catalyst precursor solution is made by adding 6 grams of chloroplatinic acid and 2 grams of iridium chloride to a mixture of 13 milliliters of ethanol and 215 milliliters of isopropanol. A single coating is applied to the titanium strips, dried at room temperature, and baked in an oven at 525 degrees centigrade for 30 minutes. Prior to coating with the precursor solution, the titanium strips are etched in 20 percent hydrochloric acid at 60 degrees centigrade for 30 minutes.

A one half square foot piece of the ladder anode is fixed onto a 6" wide by 12 inches long by 4 inches deep block of concrete containing four, one half inch diameter, 12 inches long steel reinforcing bars using plastic push pins. The concrete block is made of a commercial mixture of Portland cement, gravel, and water, to an uncured concrete slump rating of 2 inches. Sodium chloride is added to the concrete at 15 pounds per cubic yard. After the anode is fixed to the surface, a 2 inch overlay of the same concrete formulation is placed onto the sample and allowed to cure. Uncovered end portions of the anode and the rebar are connected to the positive and negative leads, respectively, of a source of DC power, and the system is turned on to effect cathodic protection of the steel. The system is operated at 40 ma/ft$^2$ current density on the anode surface. The system voltage remains steady at about 3.5 to 4.0 volts for over 1000 days.

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

What is claimed is:

1. A flexible, non-stretchable ladder electrode for use in a cathodic protection system for the cathodic protection of a steel reinforced concrete structure comprising two longitudinally extending and a plurality of laterally extending, spaced apart, porous or non-porous metal strips, said strips comprising titanium or alloys thereof, said longitudinally extending strips are electrically connected to the laterally extending strips at the intersections thereof to form a ladder, said electrode has a surface area of 500 to 900 square inches per pound, and said electrode has electrically connected thereto at least one electric current-carrying, spaced apart, non-porous metal member consisting of titanium or alloys thereof.

2. The ladder electrode of claim 1 wherein said metal strips are rectangular in shape, and carry on their surface an electrocatalytically active metal coating, and said metal strips have a thickness of about 0.02 to about 0.08 centimeter and a width of about 0.2 to about 1.5 centimeter.

3. The ladder electrode of claim 2 wherein said metal strips are connected by welding and said electrocatalytically active metal coating is formed of at least one platinum group metal or a composite comprising a valve metal or alloys or oxides thereof and at least one electrocatalytically active metal or oxide thereof.

4. The ladder electrode of claim 3 wherein said metal coating is a composite comprising titanium or alloys thereof containing up to 10% by weight of an alloying metal and an electrocatalytically active metal or metal oxide thereof wherein said metal is selected from at least one of the group consisting of the platinum group metals, tin, nickel, cobalt, and manganese.

5. The ladder electrode of claim 4 wherein said electrode is operated in a cathodic protection system at an anode current density of up to about 20 milliamps per square foot.

6. The ladder electrode of claim 5 wherein said cathodic protection system is operated at an anode current density of about 0.1 to about 15 milliamps per square foot.

7. The ladder electrode of claim 6 wherein said composite consists essentially of titanium and two or more platinum group metals.

8. A concrete structure comprising steel reinforced concrete and at least two flexible, non-stretchable ladder anodes each comprising two longitudinally extending and a plurality of laterally extending, spaced apart, porous or non-porous, intersecting metal strips which are electrically connected at the intersections thereof to form a ladder; said strips comprising titanium or alloys thereof, said longitudinally extending metal strips are electrically connected by at least one spaced apart, electric current-carrying, non-porous metal member consisting of titanium or alloys thereof; and said ladder anode has a surface area of 500 to 900 square inches per pound wherein variable current density on said concrete structure is obtained by varying the spacing between adjacent ladder anodes.

9. The concrete structure of claim 8 wherein said metal strips are rectangular in shape, said metal strips carry on their surface an electrocatalytically active metal coating, and said metal strips have a thickness of about 0.02 to about 0.08 centimeter and a width of about 0.25 to about 1.5 centimeter.

10. The concrete structure of claim 9 wherein said metal strips are connected by welding and said electrocatalytically active metal coating is formed of at least one platinum group metal or a composite comprising a valve metal or alloys or oxides thereof and at least one electrocatalytically active metal or oxide thereof.

11. The concrete structure of claim 10 wherein said metal coating is a composite comprising titanium or alloys thereof containing up to 10% by weight of an alloying metal and an electrocatalytically active metal or metal oxide thereof wherein said metal is selected from at least one of the group consisting of the platinum group metals, tin, nickel, cobalt, and manganese.

12. A method of forming a variable current density, cathodic protection system for cathodically protecting a steel reinforced concrete structure, said method comprising:

A. applying to a surface of said steel reinforced concrete structure at least two flexible, non-stretchable ladder anodes having a surface area of 500 to 900 square inches per pound; said ladder anodes each comprising two longitudinally extending porous or non-porous metal strips and a plurality of laterally extending, intersecting, spaced apart, porous or non-porous metal strips connected at the intersections thereof to form a ladder; said metal strips comprising titanium or alloys thereof; said ladder anodes are electrically connected by at least one spaced apart, electric current-carrying, non-porous, metal member laterally extending across at least two of said ladder anodes; and said metal members consisting of titanium or alloys thereof; wherein the anode current density is maintained at about 5 to about 10 mA/ft$^2$ and the current density on said concrete structure varies with the spacing between adjacent ladder anodes and;

B. covering said ladder anodes with an ion conductive overlay.

13. The method of claim 12 wherein said metal strips carry on their surface an electrocatalytically active coating and said metal strips have a thickness of about 0.02 to about 0.08 centimeter and a width of about 0.2 to about 1.5 centimeter.

14. The method of claim 13 wherein said metal strips and metal members are connected by welding and said electrocatalytically active metal coating is formed of at least one platinum group metal or a composite comprising a valve metal or alloys or oxides thereof and at least one electrocatalytically active metal or oxide thereof.

15. The method of claim 14 wherein said metal coating is a composite comprising titanium or alloys thereof containing up to 10 percent by weight of an alloying metal and an electrocatalytically active metal or oxide thereof wherein said metal is selected from at least one of the group consisting of the platinum group metals, tin, nickel, cobalt, and manganese.

16. The method of claim 15 wherein said ladder anode is operated in a cathodic protection system at an anode current density of up to about 20 milliamps per square foot and said metal strips consist of titanium containing up to 10% by weight of an alloying metal.

17. The method of claim 16 wherein said cathodic protection system is operated at an anode current density of about 0.1 to about 15 milliamps per square foot.

18. The method of claim 15 wherein said metal of said composite consists essentially of titanium and two or more platinum group metals.

19. In a coiled ladder anode for use when uncoiled as an anode for the cathodic protection of steel reinforcement in a concrete article, the improvement where said anode comprises: two longitudinally extending and a plurality of laterally extending, spaced apart, intersecting, metal strips comprising titanium or alloys thereof, said longitudinally and laterally extending strips are electrically connected at the intersections thereof to form a flexible, non-stretchable ladder anode having a surface area of 500 to 900 square inches per pound and said ladder anode is electrically connected to at least one laterally extending, spaced apart, non-porous, electric current-carrying, metal member consisting of titanium or alloys thereof.

20. The coiled anode of claim 19 wherein said metal strips are rectangular in shape, non-porous and carry on their surface an electrocatalytically active metal coating, and said metal strips have a thickness of about 0.02 to about 0.08 centimeter and a width of about 0.2 to about 1.5 centimeter.

21. The coiled anode of claim 20 wherein said metal strips are connected by welding and said electrocatalytically active metal coating is formed of at least one platinum group metal or a composite comprising a valve metal or alloys or oxides thereof and at least one electrocatalytically active metal oxide.

22. The coiled anode of claim 21 wherein said metal coating is a composite comprising titanium or alloys thereof containing up to 10% by weight of an alloying metal and an electrocatalytically active metal or oxide thereof wherein said metal is selected from at least one of the group consisting of the platinum group metals, tin, nickel, cobalt, and manganese.

23. The coiled anode of claim 22 wherein said anode is operated in a cathodic protection system at an anode current density of up to about 20 milliamps per square foot.

24. The coiled anode of claim 23 wherein said cathodic protection system is operated at an anode current density of about 0.1 to about 15 milliamps per square foot.

25. The coiled anode of claim 24 wherein said electrocatalytically active metal coating is a composite consisting essentially of titanium and two or more platinum group metals.

26. A flexible, non-stretchable ladder electrode for cathodic protection of a steel reinforced concrete structure comprising two longitudinally extending, porous or non-porous, intersecting, spaced apart, rectangular, metal strips comprising titanium or alloys thereof, said longitudinally and laterally extending strips are electrically connected at the intersections thereof to form a ladder, said strips have a thickness of about 0.02 to about 0.08 centimeter and a width of about 0.2 to about 1.5 centimeter, and said electrode having a surface area of 500 to 900 square inches per pound, wherein said electrode has electrically connected thereto at least one electric current-carrying, spaced apart, non-porous metal member consisting of titanium or alloys thereof.

* * * * *

UNITED STATES PATENT AND TRADEMARK OFFICE

CERTIFICATE OF CORRECTION

PATENT NO. : 6,056,867
DATED : May 2, 2000
INVENTOR(S) : John W. Burgher, Dennis F. Dong, and R. E. Loftfield It is certified that error appears in the above-identified patent and that said Letters Patent is hereby corrected as shown below:

Column 10,
Line 60, at the end of the line add -- -- per weight of titanium. Values in the above table are in square inches per pound. -- --

Signed and Sealed this

Thirty-first Day of July, 2001

*Attest:*

Nicholas P. Godici

*Attesting Officer*

NICHOLAS P. GODICI
*Acting Director of the United States Patent and Trademark Office*